US009731343B2

(12) United States Patent
Suarez Loira

(10) Patent No.: US 9,731,343 B2
(45) Date of Patent: Aug. 15, 2017

(54) PROCESS OF FORMING COPPER ANODES

(71) Applicant: ASESORIAS Y SERVICIOS INNOVAXXION SPA, Santiago (CL)

(72) Inventor: Pablo Suarez Loira, Santiago (CL)

(73) Assignee: Asesorias Y Servicious Innovaxxion SpA (CL)

( * ) Notice: Subject to any disclaimer, the term of this patent is extended or adjusted under 35 U.S.C. 154(b) by 0 days.

(21) Appl. No.: 15/301,113

(22) PCT Filed: Apr. 7, 2015

(86) PCT No.: PCT/IB2015/052501

§ 371 (c)(1),
(2) Date: Sep. 30, 2016

(87) PCT Pub. No.: WO2015/155678

PCT Pub. Date: Oct. 15, 2015

(65) Prior Publication Data

US 2017/0036264 A1 Feb. 9, 2017

(30) Foreign Application Priority Data

Apr. 8, 2014 (CL) ..... 872-2014

(51) Int. Cl.

| | |
|---|---|
| ***B22D 25/04*** | (2006.01) |
| ***B22C 9/12*** | (2006.01) |
| ***B22C 23/02*** | (2006.01) |
| ***B22D 5/02*** | (2006.01) |
| ***B05B 5/03*** | (2006.01) |
| ***B05B 13/04*** | (2006.01) |
| ***B05D 1/00*** | (2006.01) |

(52) U.S. Cl.
CPC ..... *B22C 9/12* (2013.01); *B05B 5/032* (2013.01); *B05B 13/04* (2013.01);
(Continued)

(58) Field of Classification Search
CPC .. B22D 25/04; B22D 5/02; B22C 9/12; B22C 23/02
(Continued)

(56) References Cited

U.S. PATENT DOCUMENTS 3,659,644 A * 5/1972 De Bie ..... B22D 25/04 164/122
3,682,232 A 8/1972 Bouyt
(Continued)

FOREIGN PATENT DOCUMENTS

JP 58192657 A * 11/1983 ..... B22C 23/02
JP 60003964 A * 1/1985 ..... B22D 25/04
(Continued)

OTHER PUBLICATIONS
International Search Report, PCT/IB2013/053635, Oct. 15, 2015.

*Primary Examiner* — Kevin E Yoon
(74) *Attorney, Agent, or Firm* — Tolpin & Partners, PC; Thomas W. Tolpin

(57) ABSTRACT

The present invention relates to a process of forming copper anodes (6) in a casting wheel (I) from the stage in which the copper is in liquid molten state (5) in a dumping chute (3) and is transferred to a ladle (4) until the anode (6) of solid copper is transformed into an anode (6) and is discharged from a mold (2) located in said casting wheel (I) wherein said process prevents the liquid molten copper (5) from being adhered to the edge of the ladle (4) and in the interstice (14) generated between the surfaces of the ejector rod (13) and the passing through bore (12) located on the mold (2) comprising the stages of: pouring the molten liquid copper from a distributing dumping chute (3) towards a ladle (4); (b) connecting the metallic components of the ladle (4) to the ground in order to produce positive charge (17); (c) spraying towards the edge (lip) of the ladle (4) an air jet (19) with dry dusting release agent (20) which is expelled by a nozzle (21) charging the particles of said dry dusting (20) with high voltage and negative charge the particles of said dry dusting release agent (20) with high voltage and negative charge (18); (f) pouring the molten liquid copper (5) from the ladle (4) towards the cavity (II) of a mold (2) of anodes; (g) waiting until the copper gets cold in order to form the anode
(Continued)

(6) by means of the turn of the casting wheel (I); (h) driving the ejector rod (13) to expel the anode (6) from the cavity (II) of the mold (2); and (i) removing the anode (6) from the mold (2) by means of cranes. The nozzle (21) is moved over the ladle zone (4) and mold zone (2) by means of a robotic arm (22) which is mounted on a cart (24) suspended above the casting wheel (I).(18); (b) connecting the metallic components of the mold (2) to the ground in order to produce a positive charge (17); (e) spraying towards the cavity (II) of the mold (2) and towards the location zone of the ejector rod (13) dry dusting release agent (20) through an air jet (19) which passes through a nozzle (21) which charges the particles of said dry dusting release agent (20) with high voltage and negative charge (18); (f) pouring the molten liquid copper (5) from the ladle (4) towards the cavity (II) of a mold (2) of anodes; (g) waiting until the copper gets cold in order to form the anode (6) by means of the turn of the casting wheel (I); (h) driving the ejector rod (13) to expel the anode (6) from the cavity (II) of the mold (2); and (i) removing the anode (6) from the mold (2) by means of cranes. The nozzle (21) is moved over the ladle zone (4) and mold zone (2) by means of a robotic arm (22) which is mounted on a cart (24) suspended above the casting wheel (I).

4 Claims, 11 Drawing Sheets

(52) U.S. Cl.
CPC ..... *B05B 13/0431* (2013.01); *B05D 1/007* (2013.01); *B22C 23/02* (2013.01); *B22D 5/02* (2013.01); *B22D 25/04* (2013.01)

(58) Field of Classification Search
USPC ..... 164/72
See application file for complete search history.

(56) References Cited

U.S. PATENT DOCUMENTS 4,267,877 A * 5/1981 Leiponen ..... B22D 25/04 164/130
5,064,051 A * 11/1991 Blundy ..... B22D 5/02 164/270.1
5,437,326 A 8/1995 Graham

FOREIGN PATENT DOCUMENTS

JP 2006061949 A * 3/2006
WO WO 2009/106689 A1 9/2009
WO WO 2015/155678 A1 10/2015

* cited by examiner

PREVIOUS ART

PREVIOUS ART

PREVIOUS ART

PREVIOUS ART

PREVIOUS ART

PREVIOUS ART

PREVIOUS ART

PROCESS OF FORMING COPPER ANODES

TECHNICAL FIELD OF THE INVENTION

The present invention relates to a process of forming copper anodes within a casting wheel from the stage in which the copper is in liquid molten state in a dumping chute and is transferred to a ladle until the solid copper is transformed into an anode and is discharged from a mould located in said casting wheel, wherein said process prevents the molten liquid from being adhered to the edge of the ladle as well as in the mould.

More specifically, the invention comprises the application of a release dusting agent without water on casting ladles and in the mould during the manufacture process of copper anodes.

BACKGROUND OF THE INVENTION

Currently, the anode casting process is based on casting molten cooper on a mould (usually made of copper) which contains the cavity in the shape of the desired anode.

Once the copper has been cast, it goes through a process of rapid cooling by means of sprinklers, and an ejector in the shape of a rod or steel cylinder which ejects the anode that has already been solidified.

In general, moulds are mounted on a rotating carousel or "casting wheel" in such a way that the rotating thereof allows for the continuous process of casting, cooling and ejecting the anodes.

Each mould when finishing one turn of the wheel is again filled with cooper and so on.

In order for the liquid cooper not to get adhered to the mould and can be ejected by the rod, it is necessary to add a layer of the release dusting agent material which acts as an isolation material and prevents the liquid copper from being adhered to the solid copper of the mould.

The worldwide used material is a derivative from calcium powder or barite powder which are mixed with water and sprayed by sprinklers on the inner faces of the mould.

As they are non-water soluble materials, the solution must be permanently agitated so as the powder is not precipitated.

When being applied with sprinklers it is decanted by gravity on the mould in a way that mostly covers the lower zones thus generating a thinner layer with reduced coverage on the vertical side faces of the mould.

This method of adding a release dusting agent is practically used worldwide on every casting wheel in the manufacture of copper anodes, however this has a big disadvantage which is that the water reacts in a explosive way when in contact with the liquid copper and therefore the application of the release dusting agent on the aqueous solution must be done before the liquid copper is poured by the ladles and it should be guaranteed that the mould is hot enough so as it evaporates a 100% of the water applied with the release agent, on the contrary, any drop will cause a chemical explosive reaction which can leave a crater on the anode, which will cause its immediate rejection or in the worst case scenario could cause such a big explosion which can result in damaging both equipment and the personnel in charge of them, both types of situations have happened and been registered.

Another present problem is that the mouths of ladles which cast the liquid copper must be cleaned in-between castings in order to prevent the copper from solidifying and subsequently that the mouths are closed, which are an obstacle for the right casting and even distribution of the molten inside the mould which is absolutely necessary for the right shape for the anode.

In turn, if the mouths of ladles are closed by accumulation of solidified copper, it occurs a phenomenon in which the cast copper falls in the shape of jets and not with the shape of cascade as normally occurs.

This jet concentrates all of the copper casting in one single point, thereby displacing the release agent applied to the mould, thus causing the anode to adhere to the mould, which implies that both the anode and the mould must be discarded and removed from the casting wheel which results in halting the production process.

In order to avoid this situation, an operator must be permanently exposed to the heat and liquid cooper so as to manually throw powder release agent on the mouths of ladles.

As the ladles contain liquid copper, it is not feasible to apply a coverage by means of sprinklers considering the explosion that would take place, therefore the operator is obligated to perform the manual constant application in big quantities of said agent, since the powder does not have adhesion capacity by itself and it is not adhered to the ladle, being rapidly displaced in each copper casting on the mould.

There are some release agents having an electrostatic principle in the state of the art.

For example, document CA 2345922 discloses a method for coating an extrusion plate which is at 450° C. by means of a BN powder as a separating agent which is adhered to the plate by means of an electrostatic charge.

Document GB 1288292 discloses a method for coating a mould surface of a ingot by means of spraying said coating from a nozzle against the mould surface to be coated wherein said coating contains an organic liquid suspension of granular materials which comprise 85% to 96% in weight of a refractory material and 4% to 15% in weight of an organic powder material.

The coating is applied on the mould surface by means of electrostatic charges.

Document JPS 58192657 discloses a method for coating a material of a casting mould by means of suction which attracts the material dust of the mould coating material and that is electrostatically applied with positive charge on the surface of molten iron which consists of an iron sand layer having negative charge.

Document JPS 61199543 discloses a method for improving the quality of a product by means of the utilization of a painting containing electrostatically refractory particles with respect to a part of the mould shielding and the coating of a fixing agent to said element thereby forming a material layer for coating the mould.

Document KR 20090082106 discloses an oil type release agent for metal casting characterized in that contains 0-7.5% by mass of water consisting of one or two kinds of water selected from distilled water, ion-exchange kinds of water, tap water and water includes any one of aforementioned kinds of water and electrolyte(s) dissolved in any one of aforementioned kinds of water, and 0.3-30% by mass of a solubilizing agent.

Also, it discloses a spray method using this oil type release agent, and an electrostatic spray apparatus for this oil type release agent for a mould.

U.S. Pat. No. 5,437,326 discloses the Electrostatic application of a dusting of dry, electrostatically adherable, thermally insulative powder particles over a workface of a continuous metal-casting machine in which the mould surface or surfaces which provide the workface or workfaces revolve in a generally oval course.

A dry dusting of protective powdery refractory material is applied to the workface after being entrained in an air stream and electrostatically charged by suitable electrostatic apparatus.

The workface to be dusted is electrically grounded for attracting the charged powder particles for adhering them to the workface.

The resultant coating formed by the dusting so deposited is remarkably uniform over a substantial area of the workface, a phenomenon explainable by mutual electrostatic repulsion of the dry powder particles being deposited.

In this method continuously re-applied dusting over the workface during a continuous cast provides an immediately useful repair or replacement of dusting powder lost from the coating on the workface of a revolving mould surface during casting. The dusting may be continuously removed.

The dusting may be removed at will by means of air.

None of the aforementioned documents approaches the technical problems in order to prevent copper from being adhered to the edge of the ladle and also to prevent the ejector rod located below the copper anode mould from being adhered therein due to the molten copper gets adhered between the rod and the mould as the molten coppers gets cold.

The present invention solves these problems by using a device which spray dry dusting through an air jet wherein it goes through a nozzle which charges the particles with high voltage and negative charge.

In turn, the metallic pieces being part of the ladles are connected to ground (positive charge) with which the sprayed particles are attracted and adhered to the ladle surface as well as to the metallic surfaces by the difference of charges.

In this way, it is not necessary to use water as a conductive means of the release agent and it can be directly sprayed on the ladles containing liquid copper.

In addition, the invention can be implemented as a manual tool keeping the operator away from the direct contact with copper or else can be mounted on a robotic arm with a sliding rails system in such a way the process can be made automated.

Another advantage of this invention is that the same robotic arm, sliding rails or manual tool can spray the release agent directly on the mould in which the copper would be poured, in this way the installation of the automated station injecting the release liquid agent which is currently used, is avoided.

On the other hand, this invention allows accelerating the anode moulding process since it is not necessary to wait for the release liquid agent to evaporate all the water in order to avoid an explosive reaction with the liquid copper.

Also, it mean an increase of safety, when eliminating the water in contact with the liquid copper during the moulding process.

Another advantage of this invention is that when using dry dusting being adhered to the surfaces with opposite charge, no displacement of the liquid release agent occurs, therefore the application will be uniform on the cavities and vertical walls of the mould as well as on the ladle.

Also, the electrostatically charged dust tends to accumulate thus achieving a much higher thickness of the decanted material in comparison to the one achieved with the application based on water.

Finally since there is no evaporation nor ebullition, the layer of the electrostatically applied release agent to the mould is very uniform and smooth, thereby improving the surface quality of the cast anode.

Due to the aforementioned, an objective of the present invention is the addition of a dusting release agent to be electrostatically adhered to the edge (lip) of the ladle in order to prevent the molten liquid copper from being adhered to said ladle.

Another objective of the present invention is adding a dusting release agent which can be electrostatically adhered to the anode mould and particularly to the ejector rod to prevent said rod from being adhered therein thereby facilitating the ejection of the anode from the mould.

BRIEF DESCRIPTION OF DRAWINGS

The accompanying drawings are included in order to provide a better understanding of the previous art and to show the details of the present invention.

DESCRIPTION OF THE INVENTION

Figure 1:
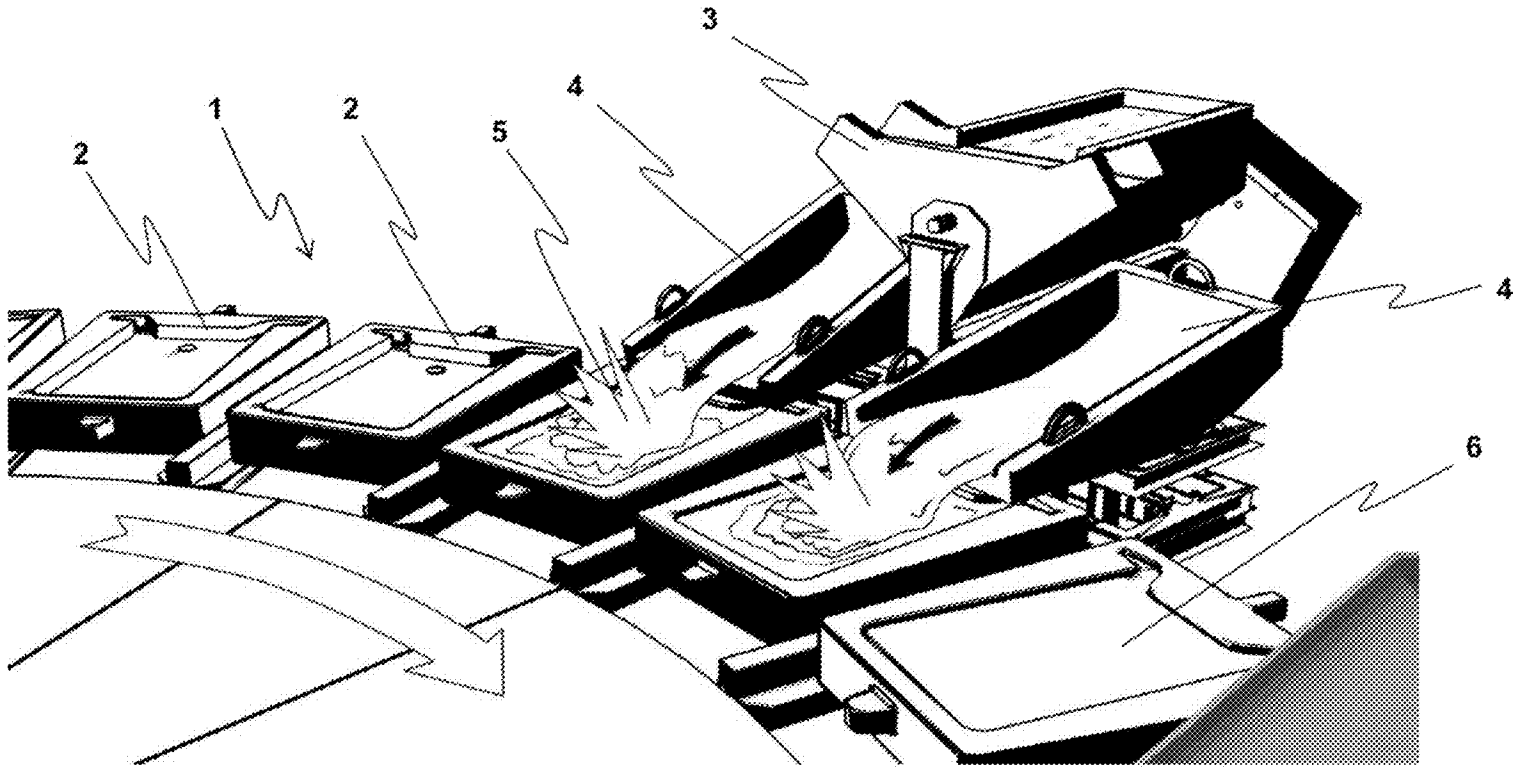
FIG. 1 shows a perspective view of the casting wheel where the ladles are pouring molten liquid copper on the moulds.

FIG. 1 shows a casting wheel (1) on which a plurality of anodes (2) are installed. Adjacent and towards the exterior of said casting wheel (1) there is a distributing dumping chute (3) which has two outlets feeding the molten liquid copper (5) to the ladles (4).

The ladles (4) once they are full with a determined quantity of molten liquid copper pour their content into the moulds (2) until they are filled and the anode is formed (6).

In order to prevent the molten liquid copper (5) from being adhered to the edge (lip) of the ladle (4), an operator (7) manually pours the dusting release agent being stored in a container (8).

Figure 2:
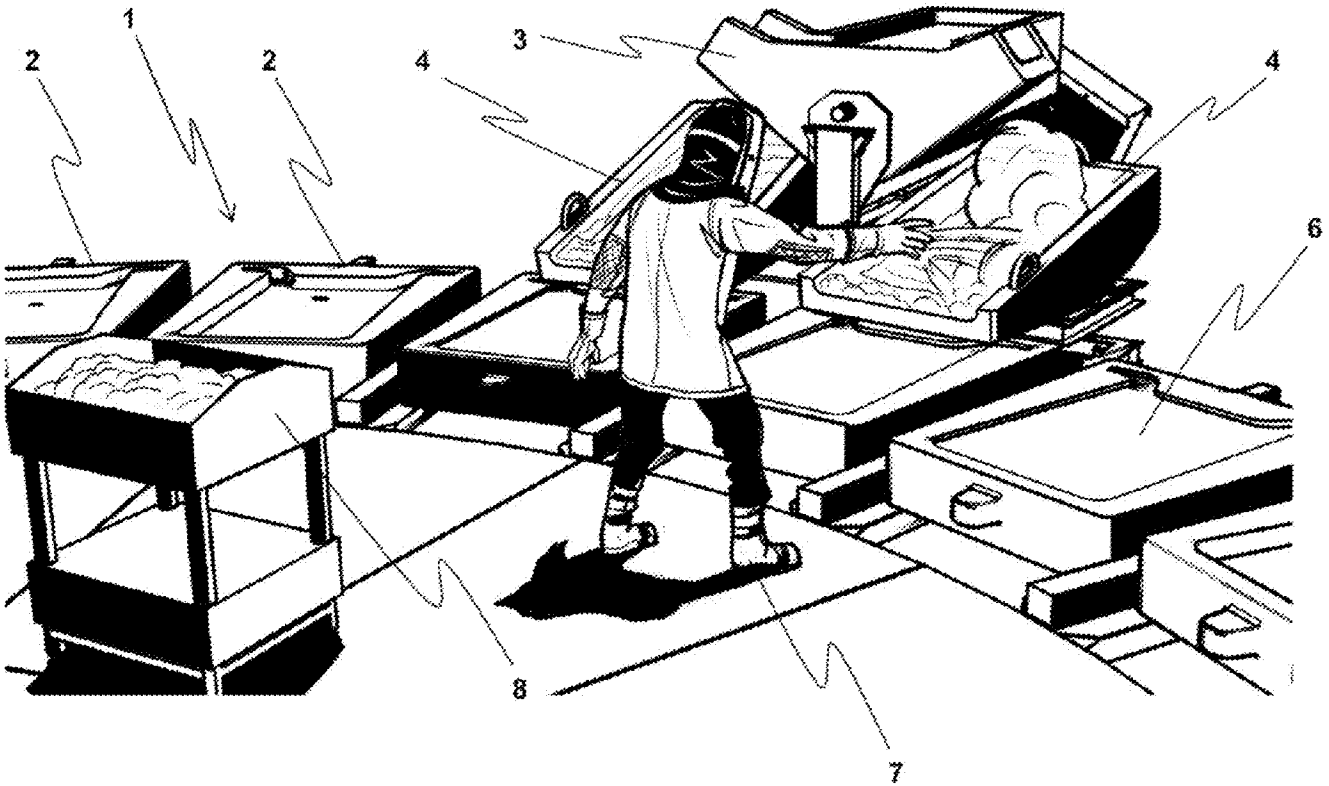
FIG. 2 shows a perspective view of the casting wheel wherein the operator is spraying the dusting release agent towards the edge (lip) of the ladle.
Figure 3:
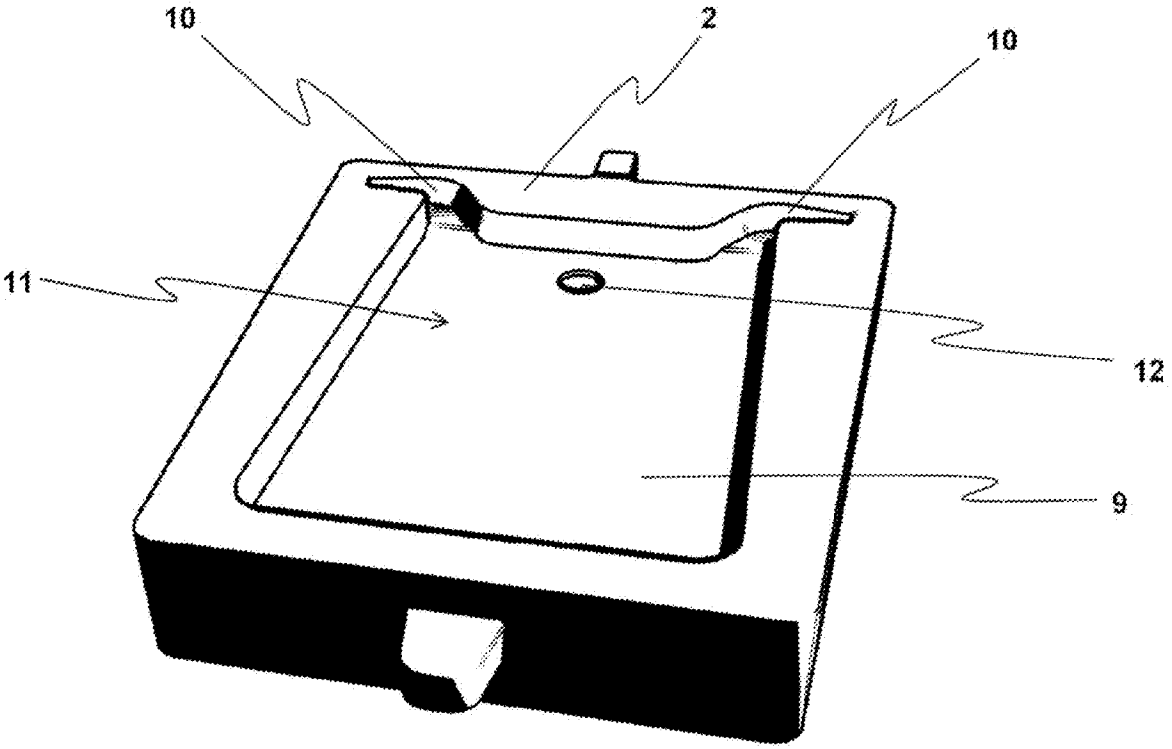
FIG. 3 shows a perspective view of an anode mould.
Figure 4:
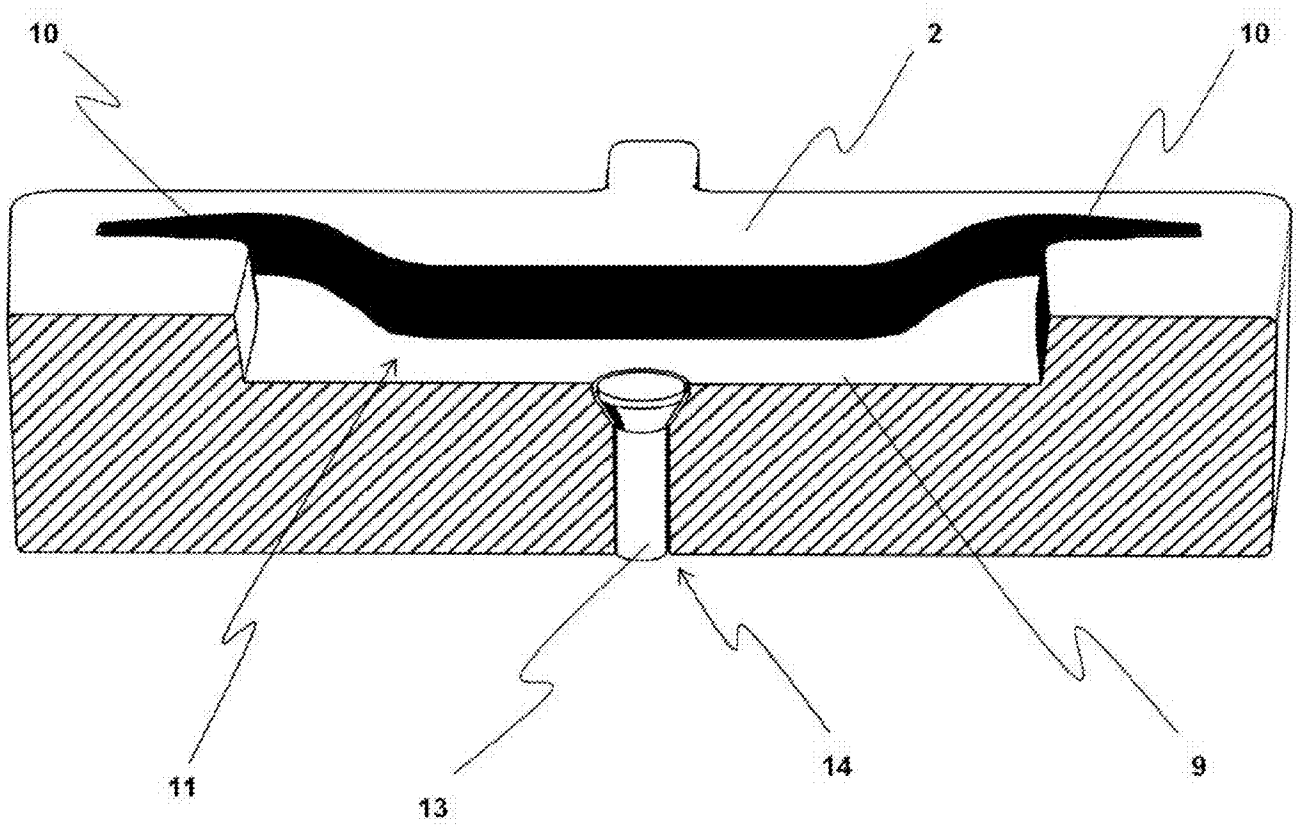
FIG. 4 shows a perspective view, in half cut, of a mould for anodes showing the detail of the ejector rod.
Figure 5:
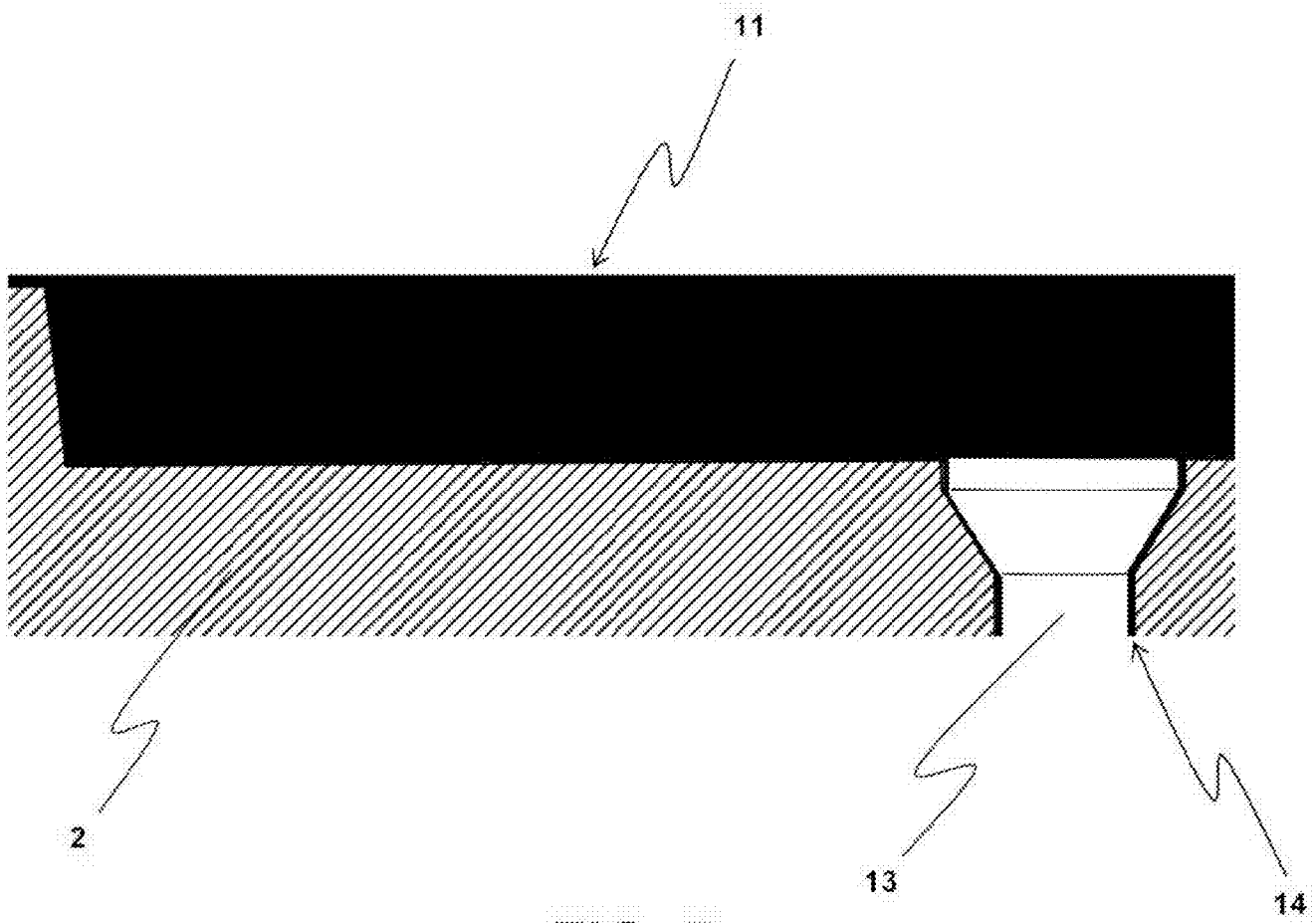
FIG. 5 shows a view, in front cut, of a mould for anodes showing the detail of the ejector rod.
Figure 6:
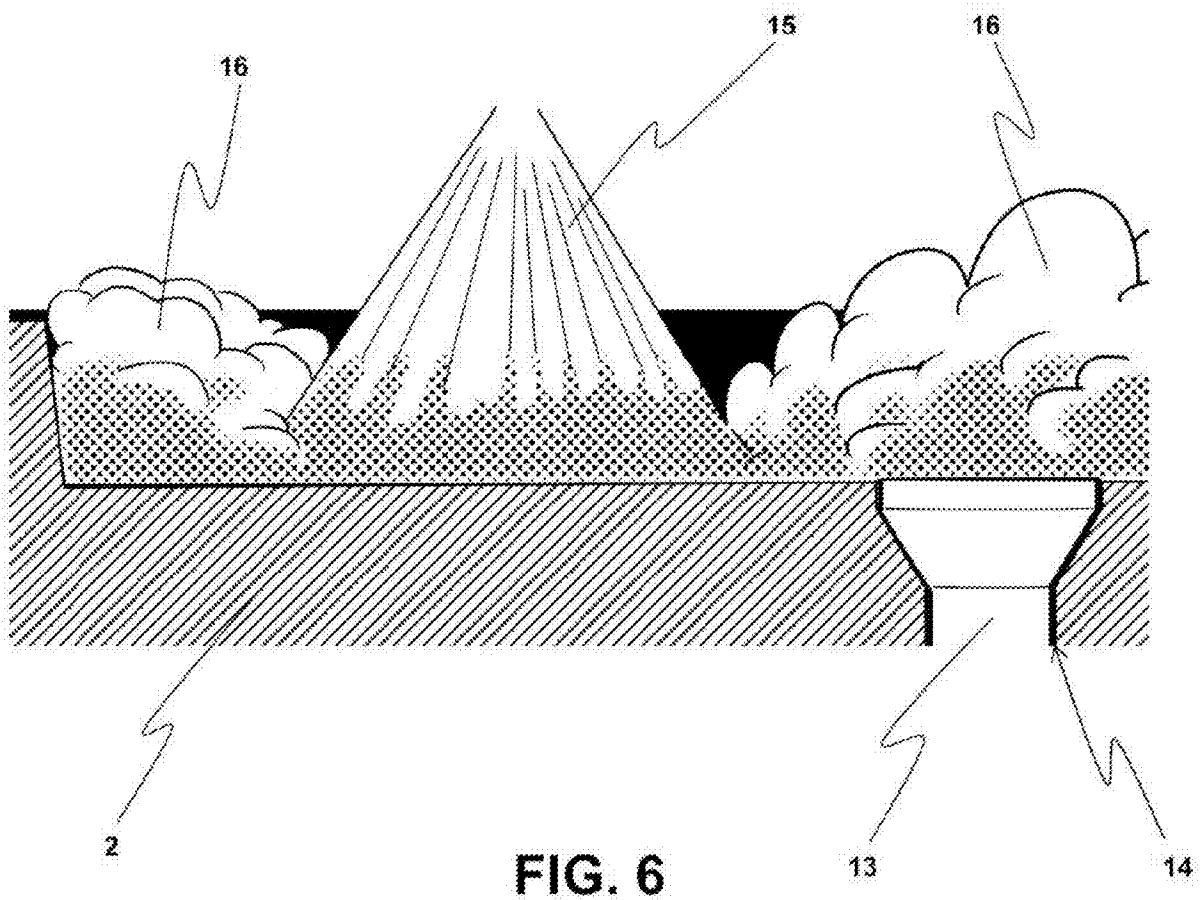
FIG. 6 shows a view, in front cut, of a mould for anodes showing the detail of the ejector rod wherein the water with the release agent is being poured.
Figure 7:
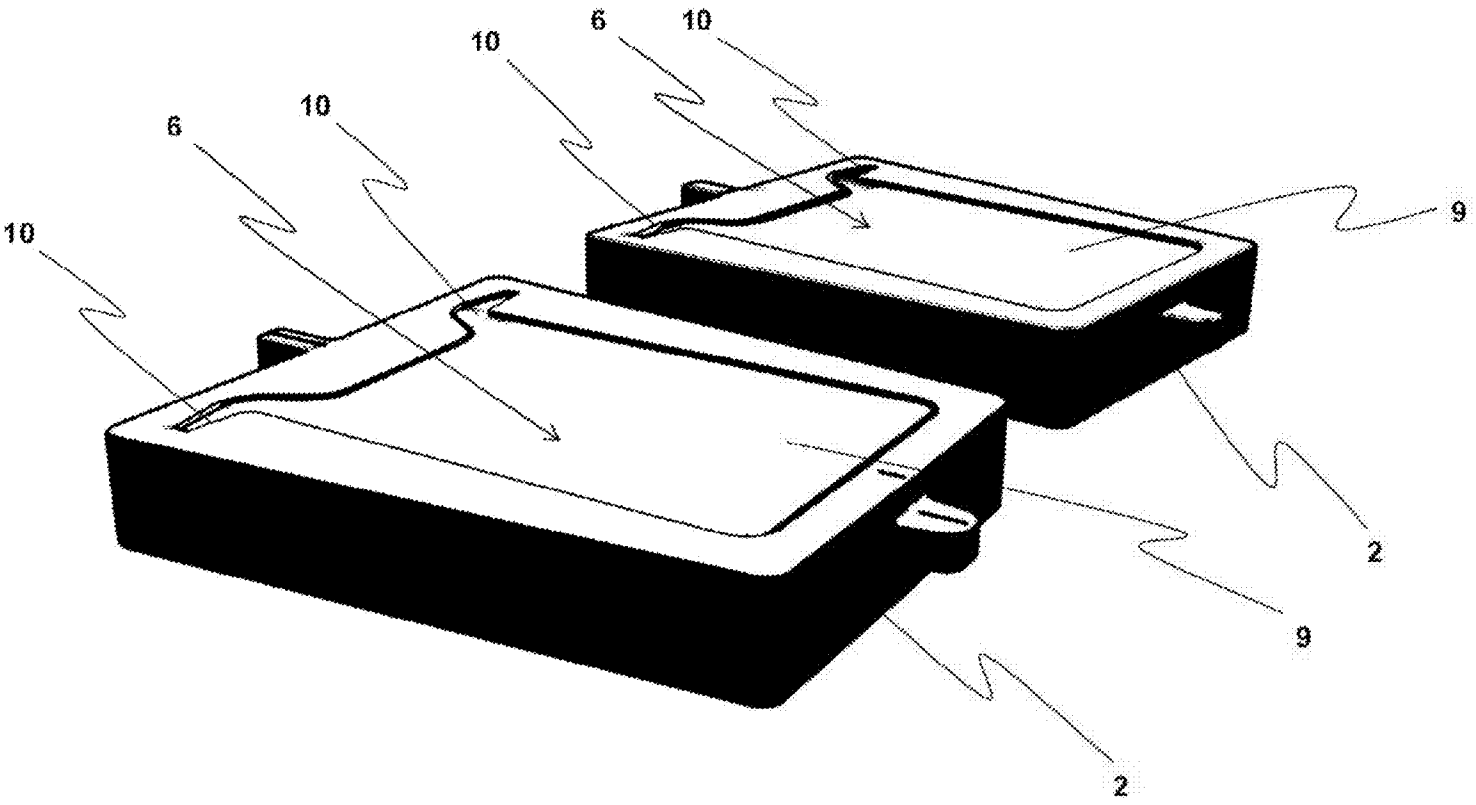
FIG. 7 shows a perspective view of two moulds with anodes molten therein.
Figure 8:
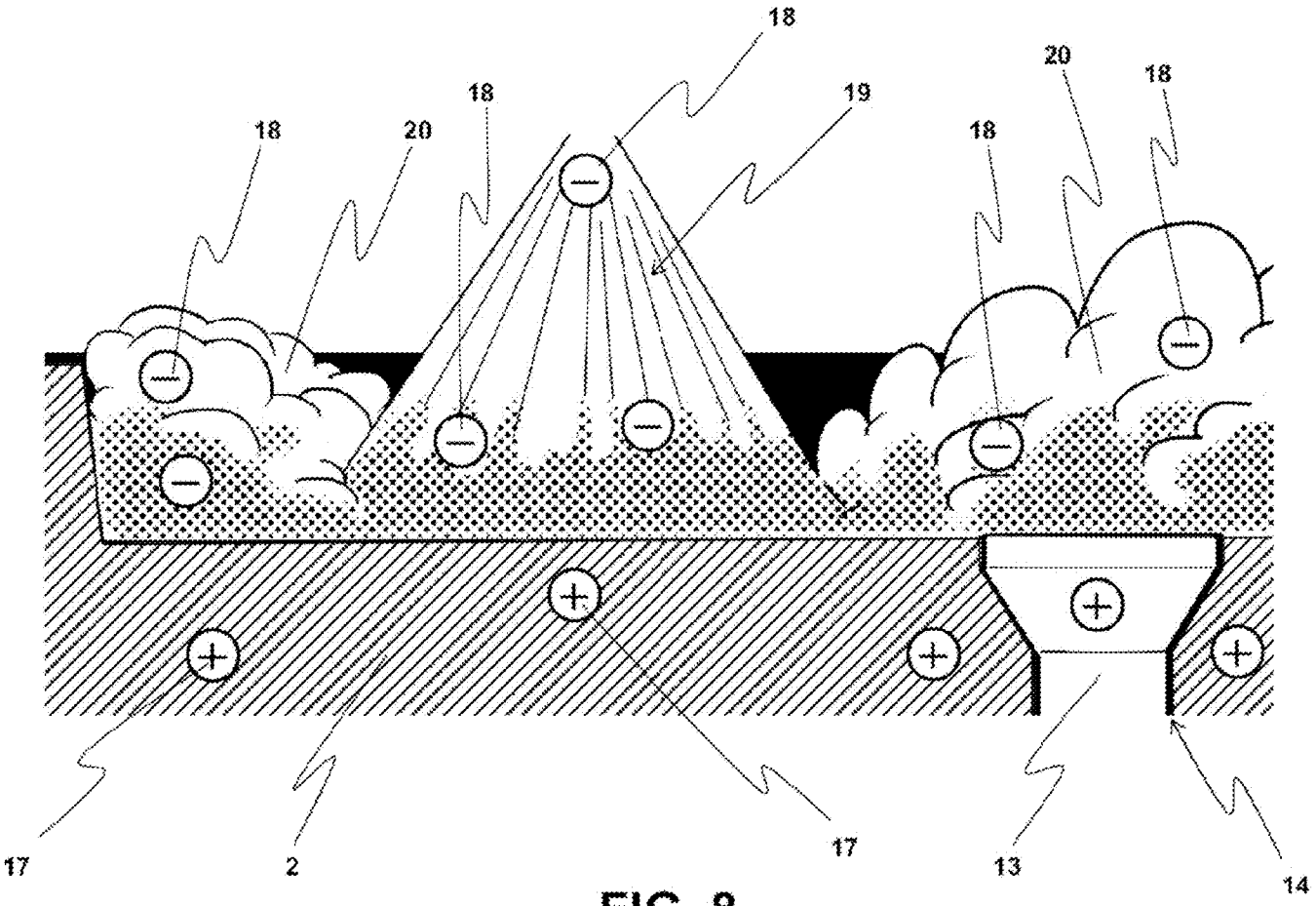
FIG. 8 shows a frontal cut view wherein the concept of the present invention is explained.

It should be noted how dangerous results the position of the operator (7) when being so close to the ladles (4) and casting wheel (1). However, without this dusting release agent, the molten liquid copper flow will be interrupted, considering that this tends to get stuck on the edge (lip) of the ladle (4). Due to the aforementioned, it is necessary to perform this dangerous maneuver showed on FIG. 2.

On the other hand, once the cavity (11) of the mould (2) is full, the casting wheel continues its circular path, with which the molten liquid copper (5) gets cold and forms the anode (6) in solid state having a body (9) and lugs (10).

In order to discharge the anode (6) from the mould (2) a passing-through bore (12) is provided in which interior is housed an ejector rod (13) thus generating between the outer walls of the passing-through bore (12) and the ejector rod (13) an interstice (14) which provides for an enough clearance for the ejector rod (13) to be moved by a drive mechanism (not shown) located below the mould.

When the drive mechanism (not shown) acts on the ejector rod (13) there is a high probability that this gets adhered inside the passing through bore (12) considering that the molten liquid copper (5) could fall inside the interstice (14) with which the ejector rod (13) cannot be lifted and therefore no detachment of the anode (6) from the mould (2) occurs.

Due to this reason, an operator (7) must throw towards the mould (2) when this is downstream of the distributing dumping chute (3) with the ladles (15) a suspension with water and release powder so as said agent is evenly sprayed on the cavity (11) and on the interstice (14).

When the suspension (15) is poured on the mould (2), due to the heat, the water generates a steam cloud (16) with which the release agent gets attached to the walls of the mould (2). In this case, the operator (7) is also exposed to a risk since be is too close to the casting wheel (1) and also because the water on the mould (2) can generate explosions.

For that reason and in order to solve those problems, the present invention proposes spraying in two areas (A, B) of the process of forming an anode (6) particles of dry dusting release agent.

These two areas are the edge zone of the ladle (4) or zone A and on the other hand, the cavity (11) of the mould (2) or zone B.

As shown in FIG. (8), the dry dusting release agent (20) is sprayed through an air jet (19) which passes through a nozzle (21) which charges the particles with high voltage and negative charge (18). In turn, the metallic pieces comprising the ladles (4) and the mould (2) are connected to the ground, thus generating a positive charge (17) with which the sprayed particles are attracted and attached to the metallic surfaces of the ladles (4) and mould (2) due to the difference of charge.

Figure 9:
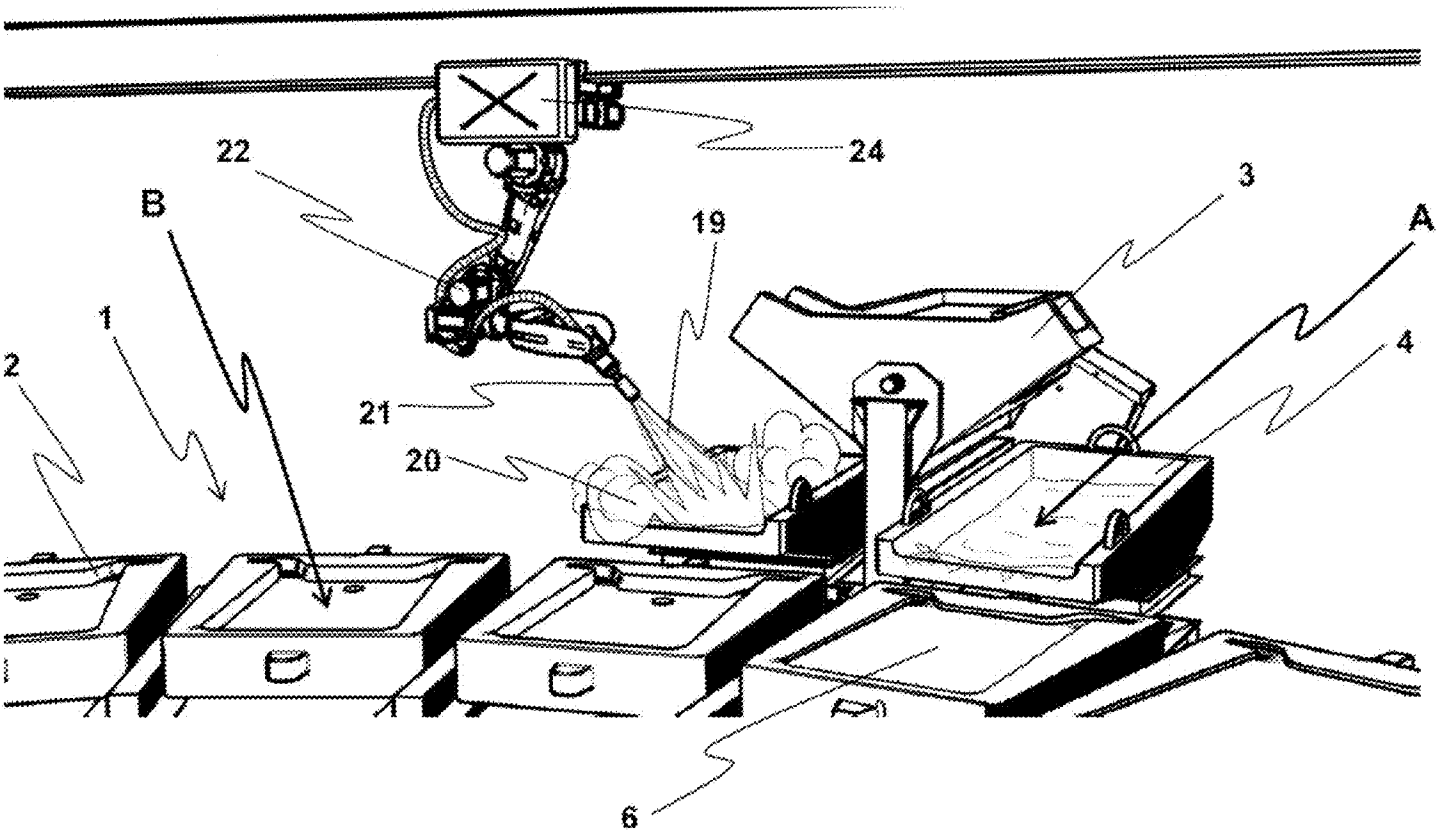
FIG. 9 shows a perspective view of the casting wheel wherein a robot spraying the dry dusting release agent towards the edge (lip) of the ladle is illustrated.
Figure 10:
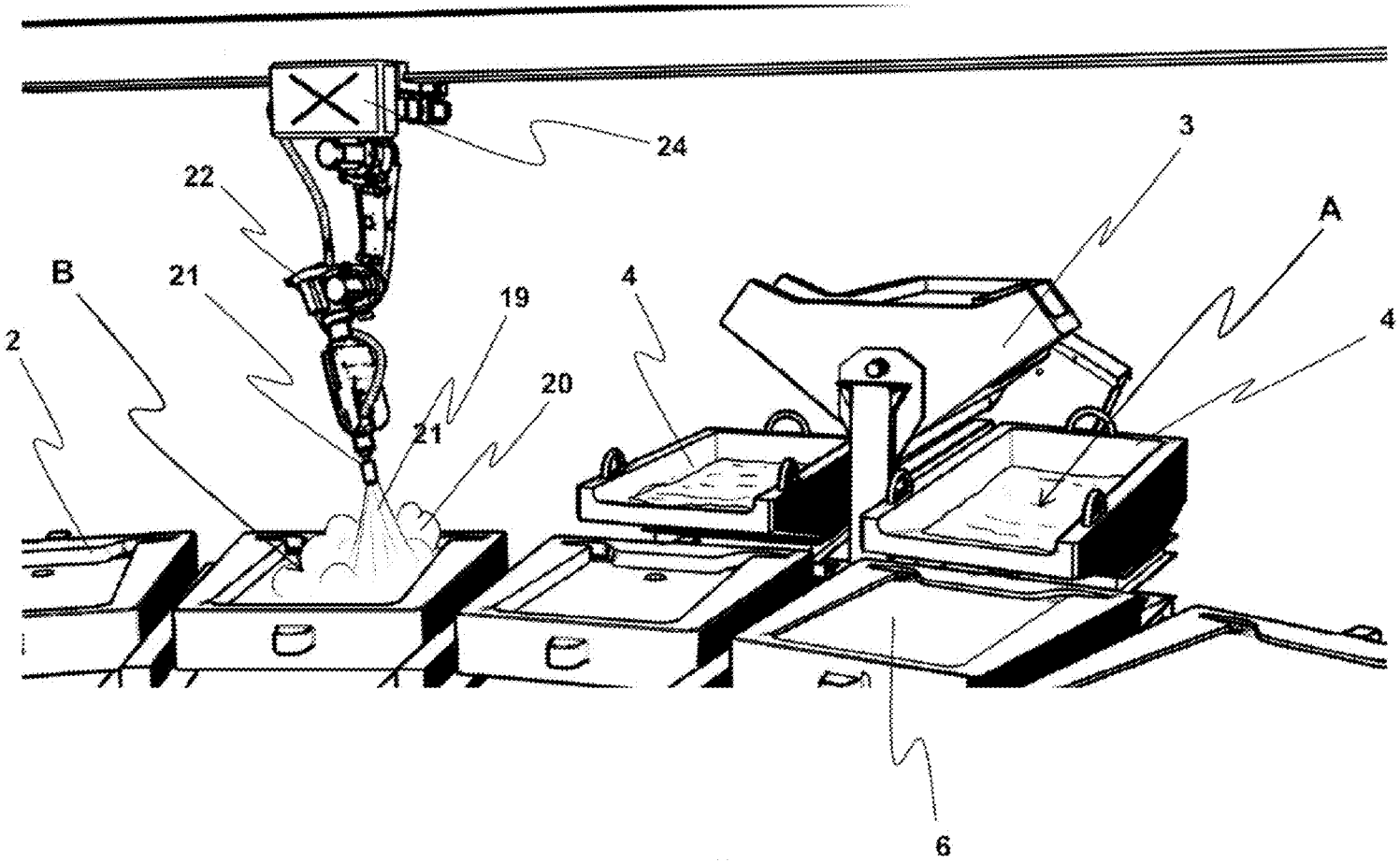
FIG. 10 shows a perspective view of the casting wheel wherein a robot spraying the dry dusting release agent on the mould for anodes.

As shown in FIGS. 9 and 10, the air jet (19) with the dry dusting release agent through a nozzle (21) can be applied on zones A, B by means of a robotic arm (22) which is installed on a cart (24) suspended above the casting wheel (1).

Figure 11:
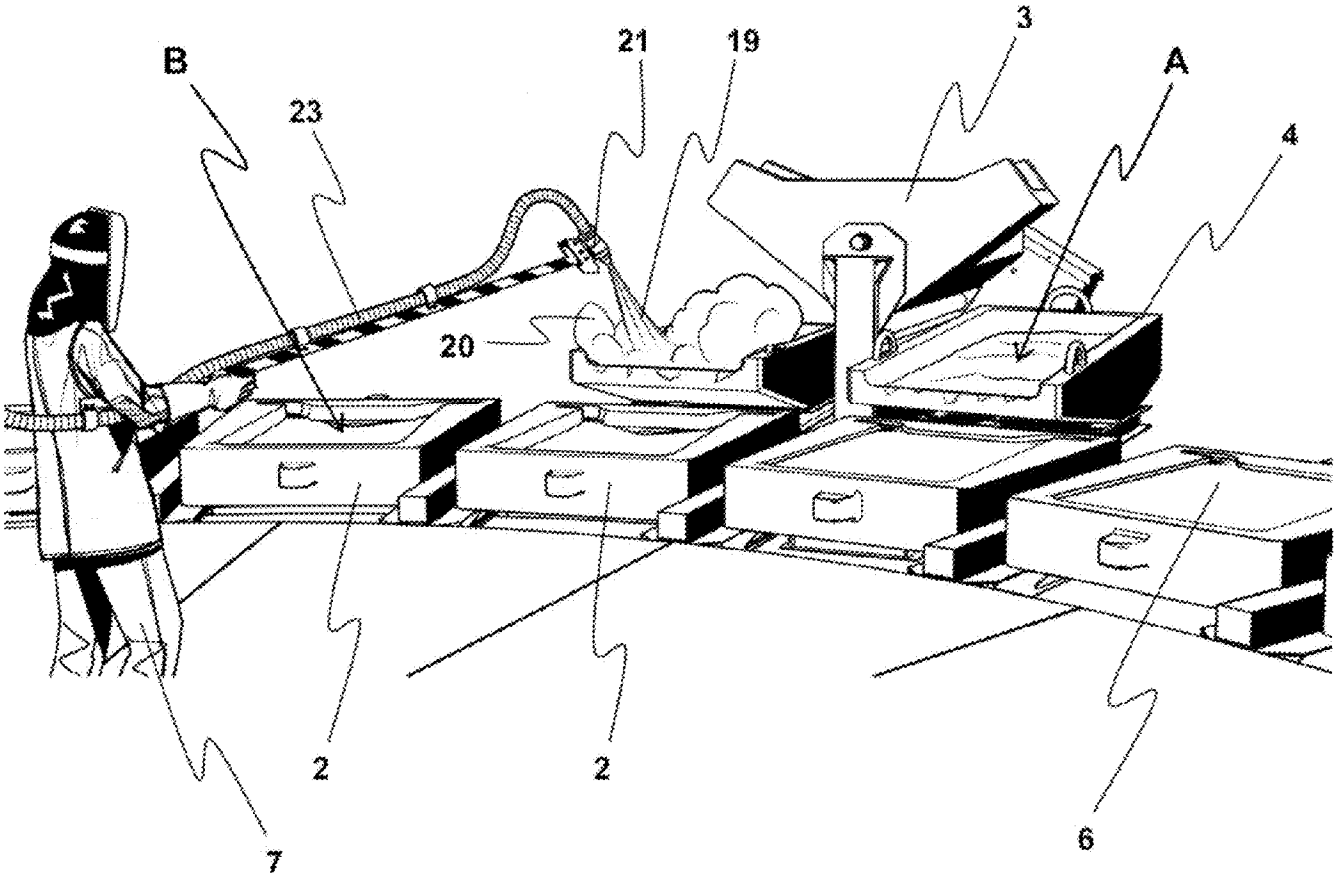
FIG. 11 shows a perspective view of the casting wheel wherein an operator spraying the dry dusting release agent on the mould for anodes using a manual tool is illustrated.

Alternatively, as shown in FIG. 11, the air jet (19) with the dry dusting release agent through the nozzle (21) can be applied on zones A, B, by means of a manual tool (23) remotely operated by an operator (7).

According to the aforementioned, the present invention relates particularly to a process of forming copper anodes (6) from the stage in where the copper is in molten liquid state (5) and is transferred to a ladle (4) until the solid copper anode, transformed into an anode (6) is ejected from a mould (2) wherein said process comprises: pouring molten liquid copper from a distributing dumping chute (3) towards a ladle (4); (b) connecting the metallic components of the ladle (4) to the ground in order to produce a positive charge (17); (c) spraying towards the edge (lip) of the ladle (4) an air jet (19) with dry dusting release agent (20) which is expelled by a nozzle (21) charging the particles of said dry dusting (20) with high voltage and negative charge (18); (b) connecting the metallic components of the mould (2) to the ground in order to produce a positive charge (17); (e) spraying towards the cavity (11) of the mould (2) and toward the location zone of the ejector rod (13) dry dusting release agent (20) through an air jet (19) passing through a nozzle (21) which charges the particles of said dry dusting release agent (20) with high voltage and negative charge (18); (f) pouring molten liquid copper (5) from the ladle (4) into a mould (2) of anodes; (g) waiting until the copper gets cold in order to form the anode (6) by means of the turn of the casting wheel (1); (h) driving the ejector rod (13) to expel the anode (6) from the cavity (11) of the mould (2); (i) removing the anode (6) from the mould (2) by means of cranes (not shown).

The invention claimed is:

1. A process of forming copper anodes (6) in a casting wheel (1) from the stage in which the copper is in liquid molten state (5) in a dumping chute (3) and is transferred to a ladle (4) until the molten copper is transformed into an anode (6) and is discharged from a mould (2) located in said casting wheel (1) characterized in that said process prevents the liquid molten copper (5) from being adhered to an edge of the ladle (4) and in an interstice (14) generated between the surfaces of an ejector rod (13) and a passing through bore (12) located on the mould (2), the process comprising the stages of:

(a) pouring the molten liquid copper from the distributing dumping chute (3) towards the ladle (4);

(b) connecting metallic components of the ladle (4) to a ground in order to produce a positive charge (17); (c) spraying towards the edge of the ladle (4) an air jet (19) with dry dusting release agent (20) which is expelled by a nozzle (21) charging particles of said dry dusting release agent (20) with high voltage and negative charge (18);

(d) connecting metallic components of the mould (2) to the ground in order to produce a positive charge (17);

(e) spraying towards the cavity (11) of the mould (2) and towards a location zone of the ejector rod (13) the dry dusting release agent (20) through the air jet (19) which passes through the nozzle (21) which charges the particles of said dry dusting release agent (20) with high voltage and negative charge (18);

(f) pouring the molten liquid copper (5) from the ladle (4) into the cavity (11) of an anode mould (2);

(g) waiting until the copper gets cold in order to form the anode (6) by means of a turn of the casting wheel (1);

(h) driving the ejector rod (13) to expel the anode (6) from the cavity (11) of the mould (2); and (i) removing the anode (6) from the mould (2) by means of cranes.

2. A process of forming anodes (6) according to claim 1 characterized in that said nozzle (21) is moved over the ladle zone (4) by means of a robotic arm (22) which is mounted on a cart (24) suspended above the casting wheel (1).

3. A process of forming anodes (6) according to claim 1 characterized in that said nozzle (21) is moved over the mould zone (2) by means of a robotic arm (22) which is mounted on a cart (24) suspended above the casting wheel (1).

4. A process of forming anodes (6) according to claim 1 characterized in that said nozzle (21) is moved by means of a manual tool remotely operated by an operator (7).

* * * * *